United States Patent [19]

Wilkinson

[11] Patent Number: 4,590,973

[45] Date of Patent: May 27, 1986

[54] LOOM AND METHOD OF WEAVING

[75] Inventor: Jack A. Wilkinson, Walsden, England

[73] Assignee: Milliken Research Corporation, Spartanburg, S.C.

[21] Appl. No.: 683,483

[22] Filed: Dec. 19, 1984

[30] Foreign Application Priority Data

Dec. 23, 1983 [EP] European Pat. Off. ..... 83307975.5

[51] Int. Cl.[4] ..... D03D 47/12

[52] U.S. Cl. ..... 139/443; 139/100

[58] Field of Search ..... 139/100, 443, 452

[56] References Cited

U.S. PATENT DOCUMENTS

| | | | |
|---|---|---|---|
| 2,501,982 | 3/1950 | Zerbee | 139/443 |
| 3,095,910 | 7/1963 | Deady et al. | 139/443 |
| 3,168,995 | 2/1965 | Ostermann | 139/100 |
| 3,224,468 | 12/1965 | Zerbee | 139/443 |
| 3,575,217 | 4/1971 | Pfarrwaller | 139/452 |
| 3,762,449 | 10/1973 | Eilhauer et al. | 139/443 |

*Primary Examiner*—Henry S. Jaudon

*Attorney, Agent, or Firm*—Earle R. Marden; H. William Petry

[57] ABSTRACT

The invention provides a novel loom and method for weaving fabrics in which at least the weft comprises stiff strands for example in the form of tapes or bands. The weft strand (41) is frictionally gripped at one side of the warp array (40) and intermittently pushed through the shed to insert successive lengths of weft. In a preferred modification, a hollow guide (22) is advanced through the shed in the opposite direction to the pushing of the weft strand, the free or previously severed end of the strand is pushed into the hollow guide, for example by friction wheel drive (3),(31) mounted on sley (13), and the guide is retracted in the same direction and at the same time as the strand is pushed through the shed, such that the free end of the weft is inside the guide while it passes through the shed. The invention is particularly valuable for weaving fabrics from stiff tapes of carbon and other high modulus fibre composites, which has not hitherto been practicable, but it can also be usefully employed with any stiff tape, band or strand of other cross-sectional profile.

2 Claims, 6 Drawing Figures

LOOM AND METHOD OF WEAVING

The present invention relates to looms and weaving methods and provides a novel loom and method for weaving fabrics in which at least the weft comprises stiff strands for example in the form of tapes or bands.

The invention is particularly valuable for weaving fabrics from stiff tapes of carbon and other high modulus fibre composites, which has not hitherto been practicable, but it can also be usefully employed with any stiff tape, band or strand of other cross-sectional profile.

Carbon, boron and other high modulus fibres are finding increasing application for a variety of structural purposes, perhaps most notably in the aerospace industry. A recent development is that of fibre/aromatic polymer composites, which can be produced in the form of thin stiff sheets which are nevertheless thermally formable at high temperatues and can thus be shaped as necessary for the fabrication of a desired structure. An example of such a composite is APCl (Imperial Chemical Industries PLC, Petrochemicals and Plastics Division) which is based on carbon fibre and PEEK aromatic polymer sold under the trademark 'Victrex'.

Nothwithstanding the mouldability of such sheet materials, difficulty can be experienced if the element to be fabricated has a complex or sharply curved shape. For such purposes the improved drape properties afforded by a woven sheet would be highly desirable. Unfortunately, high modulus fibres tend to be brittle and can tolerate only relatively small local curvature before breaking. Since most conventional looms rely at one point or another on devices that impose relatively great local curvature on the fibrous strands being woven, they cannot be used for weaving fabrics from stiff tapes or bands of high modulus fibre composites, and such fabrics could not hitherto be produced economically.

The present invention now provides a method of weaving stiff strands, for example tapes or bands, into fabrics, and a loom for this purpose. The expressions "tape" and "band" are intended herein to refer to any narrow, flat, coherent, flexible structure of indefinite length, of any material from which such a structure can be formed and, where fibres are present, are not intended to imply any particular arrangement of the fibres in the structure.

The method of this invention is characterised in that the weft is a stiff strand, and that the strand is frictionally gripped at one side of the warp array and intermittently pushed through the shed to insert successive lengths of weft.

A preferred modification of the method is characterised in that a hollow guide is advanced through the shed in the opposite direction to the pushing of the weft strand, the free or previously severed end of the strand is pushed into the hollow guide, and the hollow guide is retracted in the same direction and at the same time as the strand is pushed through the shed, such that the said free end is inside the hollow guide while it passes through the shed.

The loom according to this invention is characterised by a cooperating pair of weft advancing wheels or rollers mounted at one side of the shed, at least one of the rollers being drivable intermittently.

According to a separate aspect of the invention, the problem of equalising tension in the warp, when the latter is composed of stiff tapes or bands, is solved by a warp supply system that comprises a series of rotatable spools maintained in side-by-side frictional engagement with one another by one or more springs, the tapes or bands being helically wound on spools, with successive spools being wound and thus delivering the tapes or bands in opposite directions.

Looms are known in which an elongate member is inserted through the shed from one side, and subsequently retracted, for the purpose of drawing a weft thread through the shed. An example of such a loom is the rapier loom, in which the free end of the rapier carries a clip which engages and grips the weft thread when the rapier is in its fully advanced position. Such a loom cannot be used to weave fabrics from stiff tapes such as carbon fibre, because the action of the conventional clip is to shatter the tape. However, the basic arrangment of such a loom can be modified to provide a loom and to carry out the method of the present invention.

For such a modification, in the case of a single rapier loom, the frictional drive for the weft strand, preferably a pair of rollers or wheels, is mounted on the sley towards one side of the loom, just beyond the extreme position reached by the nose of the rapier. The rapier itself is replaced or modified to provide the hollow guide which is preferably employed to shield the free end of the weft strand as it passes through the sley. A weft cutter may be provided in a fixed position on the loom, where it can cut the strand as it is beaten up by the movement of the sley towards the already formed fabric.

The friction drive may take a variety of forms but the preferred form, especially for flat tapes or bands, is a pair of rollers, one of which is formed with a peripheral groove corresponding to the width of the tape or band to be inserted, while the other is a roller or wheel having a width also corresponding to that of the groove and a periphery provided with a friction surface. One of the rollers or wheels, and preferably the one provided with the friction surface, is driven intermittently to advance the tape or band once during each cycle of the weaving operation. Any convenient form of drive can be employed, but an air motor is currently preferred because it is fast and positive in its action and readily controllable as to speed and time of operation.

The invention will be further described, by way of example only, with reference to the accompanying drawings in which.

Figure 1:
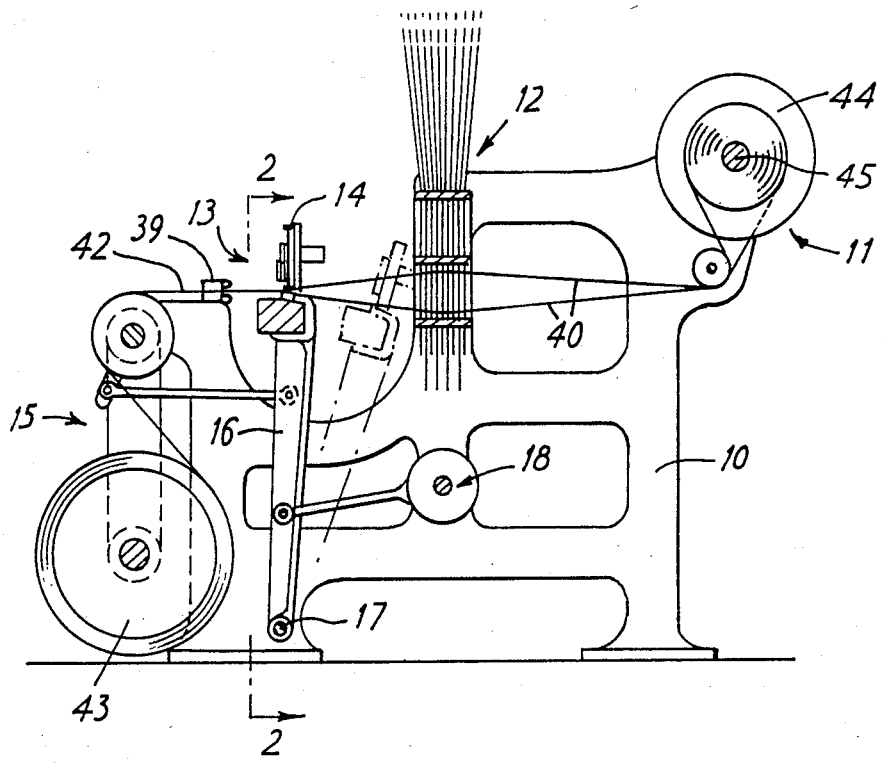
FIG. 1 is a cross-sectional view from front to back of a loom embodying the invention.
Figure 2:
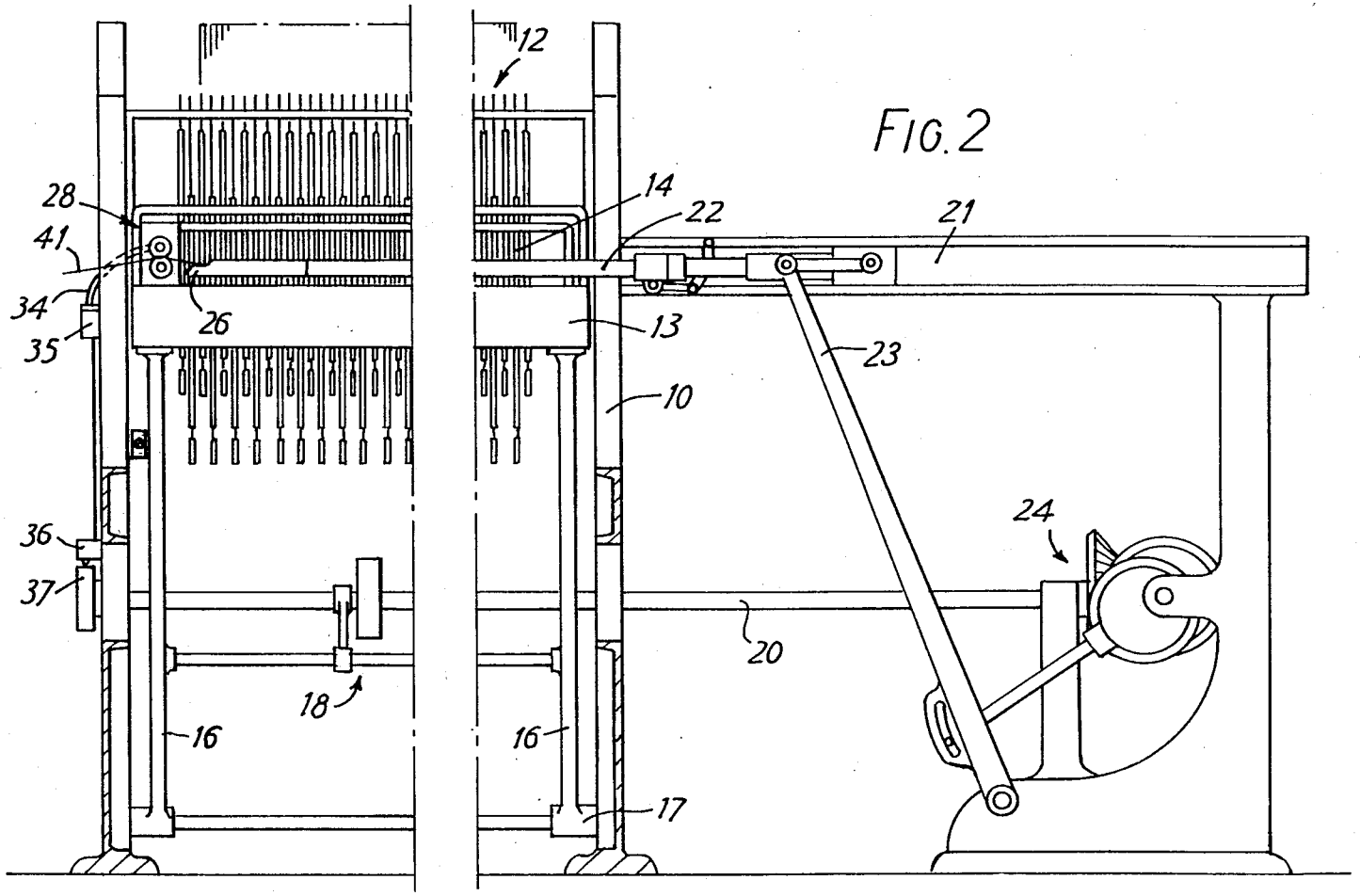
FIG. 2 is a sectional view taken along the line 2—2 in FIG. 1.
Figure 3:
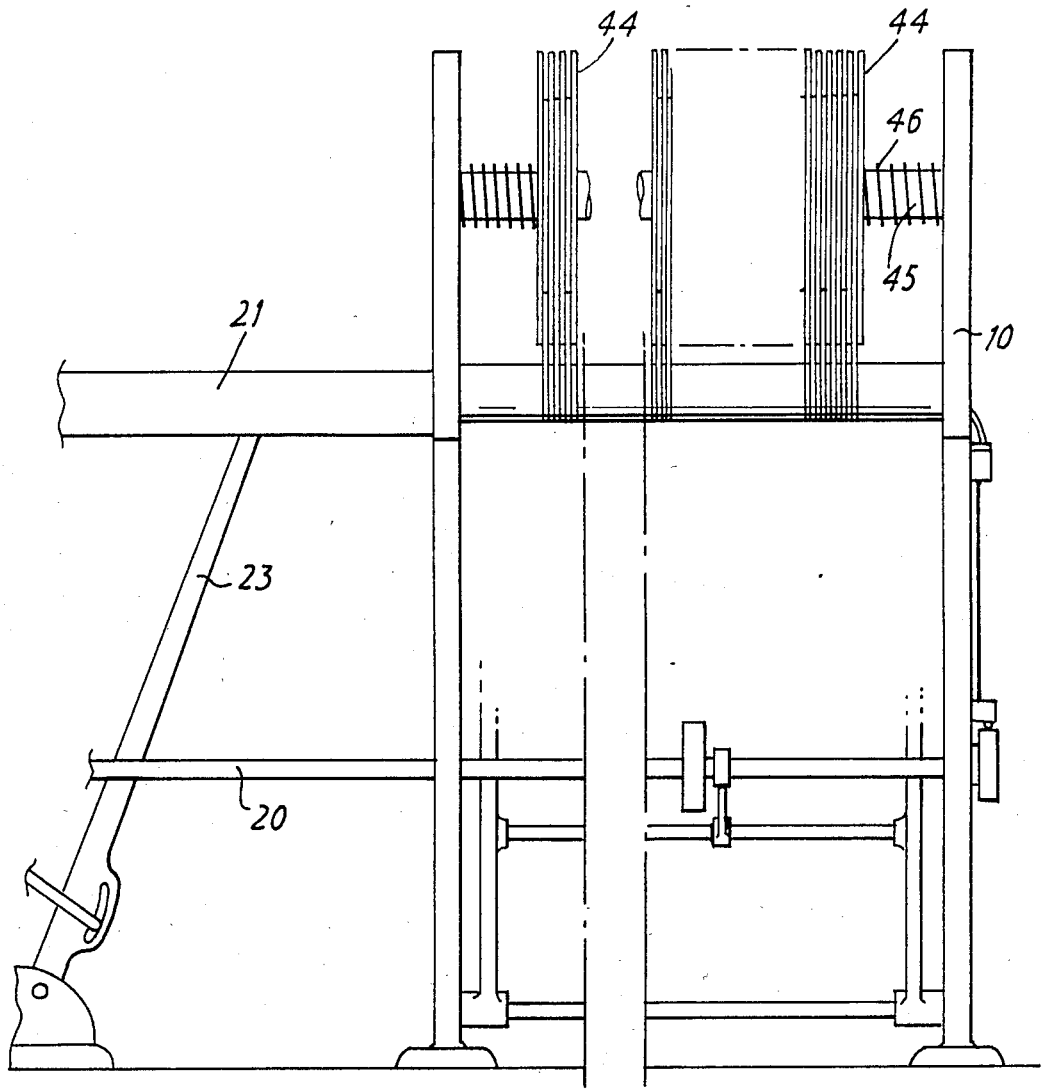
FIG. 3 is a rear view of the loom of FIG. 1.

The loom shown in FIGS. 1 to 3 has many features in common with a conventional rapier loom, but includes modifications to adapt it for the purposes of the present invention. It will be understood that many variations in the basic loom structure and mechanism, and in means for supplying warp and weft, are possible within the scope of the present invention, which may be practised on a purpose-built or on a modified existing loom, as may be found most convenient in particular circumstances.

A main frame 10 carries at the rear a warp supply system 11, a group of healds 12 for forming a shed from the warp strands, a reciprocating sley 13 supporting a reed 14, and a fabric take up mechanism 15 at the front of the loom.

The healds 12 may be of generally conventional structure except that, where the warp consists of tapes, they must be adapted for a passage of tapes of the width which is desired to weave. They may be controlled by any convenient form of patterning mechanism which, since it may be of a conventional character, is not shown the drawings.

The sley 13 is supported by arms 16 on pivots 17 in the main frame and is given its reciprocating movement by a conventional drive 18 derived from the main drive shaft 20 of the loom. The reed 14 may be adapted for the purposes of the invention by a spacing of sufficient width to pass tapes when they are to provide the warp array.

Figure 4:
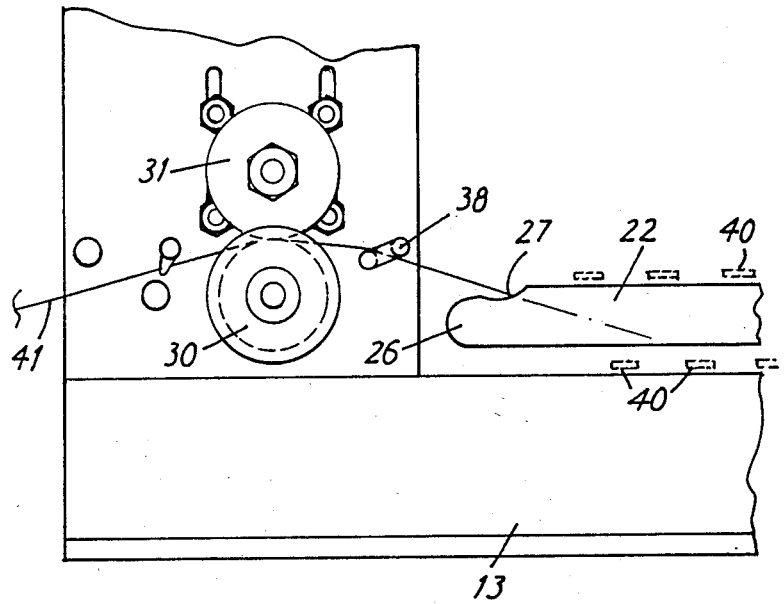
FIG. 4 is a fragmentary front view to a larger scale showing the frictional drive for the weft strand in the loom of FIG. 1.
Figure 5:
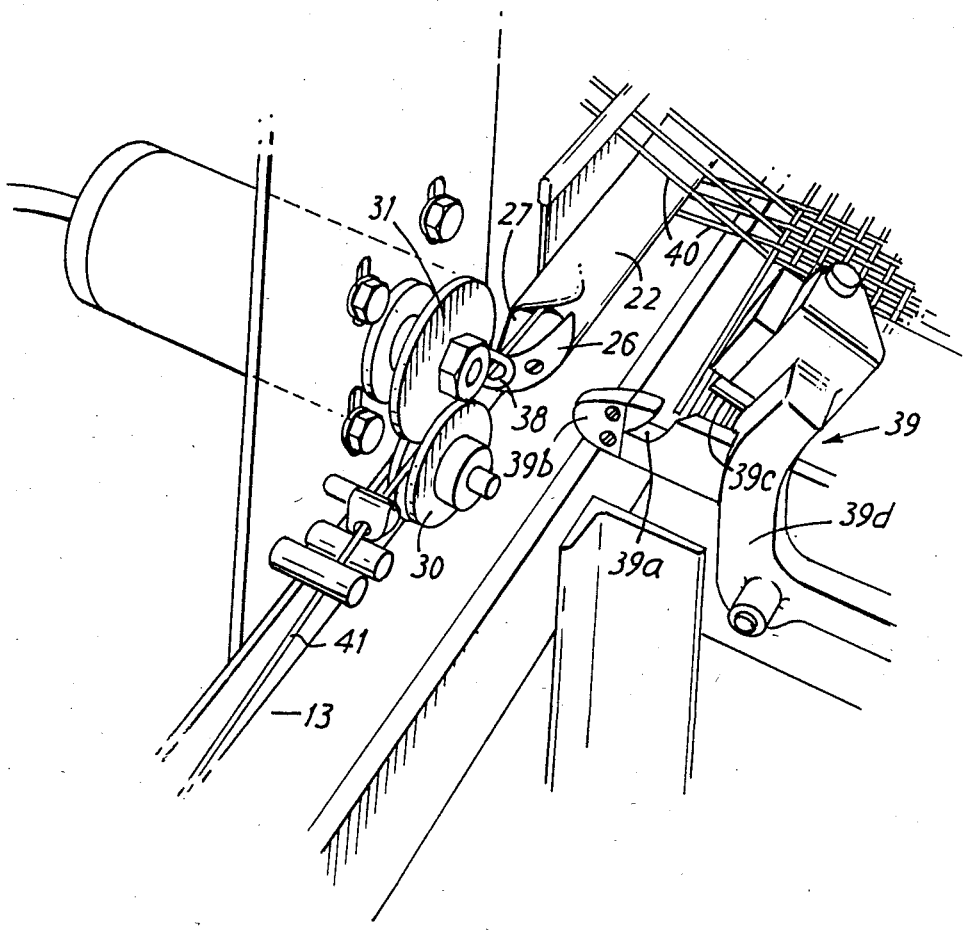
FIG. 5 is a perspective view of the frictional drive shown in FIG. 4.

To the right hand side of the loom, when viewed from the front, is a guide structure 21 supporting a reciprocating tube 22, which is advanced through the shed when the sley 13 is in its rearmost position and withdrawn from the shed before the sley begins its forward movement. Movement of the tube 22 is effected, in the loom shown in the drawing, by a swinging arm 23, which derives its movement from the main drive shaft 20 through appropriate mechanism 24, the necessary interrelationship between movements of the sley 13 and tube 22 being thereby achieved. As shown in FIG. 4, the tube has a rounded nose 26, behind which is a opening 27 in the upper surface of the tube, giving access to the hollow interior of the tube.

At the left hand side of the sley 13, as seen from the front, is fitted a pair of wheels or rollers constituting a friction drive 28 for the weft strand. In the loom shown in the drawings, which is especially suitable for weaving stiff tapes, this drive comprises a freely rotatable guide wheel 30 having a peripheral groove of an appropriate width to guide the weft tape being woven. With this guide wheel cooperates a friction wheel 31, which is of a thickness to run in the groove of the guide wheel 30 and has a peripheral surface of friction material. The wheels 30 and 31 are mounted on a plate 32 which is secured to the sley 13. One of the wheels, for example the driven wheel 31, may be carried on a slotted or otherwise adjustable mounting to accomodate wheels of different sizes. The plate 32 also carries a drive for the friction wheel, which in the loom shown in the drawing is an air motor 33 to which air supplied under pressure through a flexible line 34. The admission of air to the air motor is controlled in synchronism with the other movements of the loom by any convenient means. For example, it may be controlled by a solenoid operated valve 35 under the control of a limit switch or micro-switch 36 actuated by a cam 37 on the main drive shaft 20 of the basic loom.

On the front face of the plate 32 is also mounted, at the output side of the friction drive 28, a guide 38 for directing the advancing tape along a downwardly inclined path, whereby it can enter the access opening 27 behind the nose of the tube 22, as shown in FIG. 4, when the latter is in its fully advanced position.

A cutter 39, is mounted on the frame of the loom near the forward position of the sley and somewhat to the right of the guide 38 as seen from the front. It comprises a fixed blade **39*a*, protected by a rounded nose 39*b*, and a moving shear blade 39*c* carried by a pivoted arm 39*d*** which is operated once in each cycle by a cam (not shown) to cut the weft as the sley approaches its forward position.

In a cycle of operation, a shed is formed in the warp tapes 40 by the healds 12, and the sley moves to its rearmost position, shown in FIG. 1 in broken lines. The tube 22 is then advanced through the shed by the mechanism 24 until its nose 26 emerges from the far side of the shed and approaches the weft friction drive 28. At this point the cam 37 operates the switch 36 to open the solenoid valve 35 and operate the air motor to rotate the friction wheel 31 and advance the weft tape 41 through the shed. By virtue of the guide 38, the free end of the tape is caused to enter the tube 22 through the opening 27 and, as the weft tape advances through the shed, the tube 22 is withdrawn by the mechanism 24, the movement being timed by the controls described so that the free end of the weft tape remains within the tube until the tape has passed fully through the warp shed. When the nose 26 of the tube 22 is clear of the reed 14, the sley drive mechanism 18 moves the sley forward against the already formed fabric 42 so that the reed may consolidate the weft by a conventional beating-up action. The cutter 39 acts to sever the weft tape and, after beating-up, the sley is moved back to begin another cycle.

The time and speed of movement of the friction wheel 31, and hence of the weft tape 41, is adjustable in several ways. Timing of the operation is under the direct control of the cam 37, which can be adjustable or replaceable by cams of alternative profile. Means may also be provided to vary the air pressure to control the speed of the motor 33 when in operation. The rate of advance of the weft tape 41 can also be controlled by fitting drive wheels or rollers of different diameter.

The fabric 42 is taken up intermittently, as each weft strand is inserted, by take-up mechanism 15, which may be conventional in character, and accumulated on a roll 43.

In accordance with the further aspect of the invention, it has been found that the use of stiff and possibly brittle tapes or bands for the warp of the fabric raises problems of tensioning which are not solved by conventional beams or other warp supply systems. In the loom shown in the drawing, by way of example, this problem is solved by supplying the warp tapes 40 from a series of adjacent spools 44, which are rotatably mounted on a common shaft 45 and pressed into frictional contact with one another by compression springs 46 acting in the direction of the shaft on the outermost spool. The stiff warp takes 40 are wound on the spools in alternate directions so that, when they are drawn from the supply system, each spool rotates in the opposite direction to the spool on either side of it. It has been found that this construction affords equalisation of tension over the whole warp array without imposing undesirable stresses on the tapes, which might possibly lead to breakage.

Figure 6:
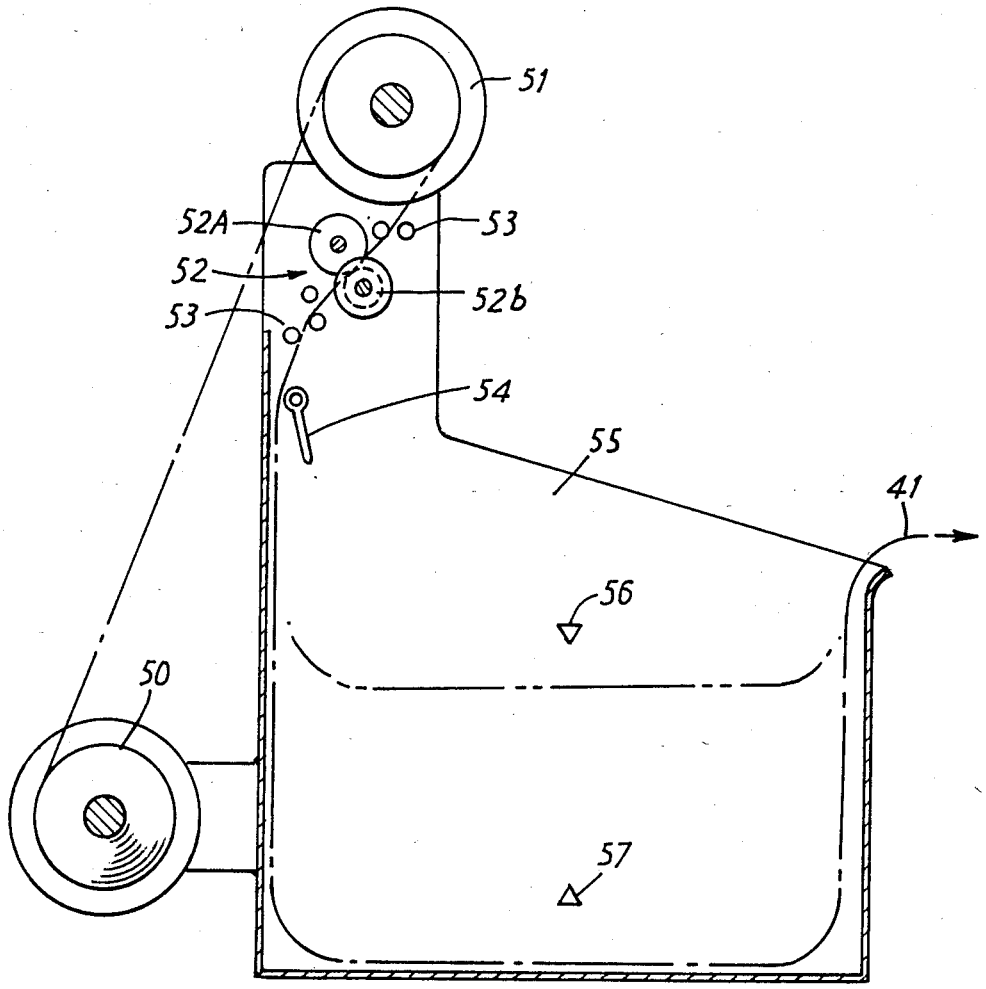
FIG. 6 is a diagrammatic view of a preferred supply system for the weft strand.

FIG. 6 shows in diagrammatic form a suitable system for supply of weft tape. The tape is drawn from a supply package 50 over a guide spool 51 by means of a friction drive 52 operated by a variable speed motor (not shown). If desired, an air motor can be used for this purpose and may drive a friction wheel **52*a* fitting a grooved wheel 52*b* similar to the weft insertion drive (30, 31). The weft tape 41 passes through guides 53 under a hinged control flap 54 into a collector box 55 of which at least two opposite panels are transparent, being fabricated by example from polymethyl polymethacrylate. Upper and lower photocells 56 and 57 define limits between which the mass in the collector box 55 may accumulate: uncovering of the lower cell 57 serves to initiate rotation of the drive 51 and obscuring of the upper cell 56 serving to terminate such rotation. From the mass accumulated in the collector box the weft tape is drawn off intermittently by the friction drive 28** on the loom.

It has been found that, by the use of the present invention, a very acceptable flat fabric can be formed from stiff tapes of carbon fibre composites, without incurring problems of breakage to which such tapes are liable on conventional equipment. It will be appreciated, however, that the same technique and equipment can also be used to insert stiff wefts of a variety of cross-sections and compositions, either into warp arrays of similar character, as in the case of fabrics formed wholly from tpes of carbon fibre composites or into warps of different character or composition and, indeed, into warps of conventional textile yarns.

I claim:

1. Apparatus to weave stiff tapes or bands comprising: a loom frame, means forming a shed in a warp array, means for supplying and passing a length of weft bands through said shed, a cutter mounted in said frame to sever the weft bands after passing through said shed, means for consolidating the weft bands between insertions through said shed and means to take up fabric after it has formed by said apparatus, said means forming a shed in warp array including a tension equalizing warp band supply system having a series of rotatably mounted spools maintained in side-by-side frictional engagement by springs, said means for consolidating the weft bands includes a reciprocating sley and reed with a pair of weft band supply rolls in operative engagement with one another and mounted thereon, one of said supply rolls being adjustably mounted relative to the other of said supply rolls, one of said supply rolls having a groove in the periphery thereof and the other of said supply rolls having a width to fit into said groove and being driven by an air motor to intermittently rotate said pair of supply rolls, said means passing a length of weft bands including a hollow guide mounted on said sley on the side opposite to said pair of supply rolls and means for timing the reciprocating movement of the guide and the intermittent driving of the supply rolls in interrelationship such that the free or previously severed end of the strand is pushed into the guide when the latter is adjacent to the pair of supply rolls, and that the guide is retracted as the free end advances through the shed, the free end remaining inside the guide until it passes out of the shed, said free end of the hollow guide is enclosed and smooth to facilitate passage through the shed and has an opening in its upper surface giving access to its hollow interior, and that a guide is mounted adjacent to the pair of supply rolls to direct the free end of the strand in a downwardly inclined direction through the opening.

2. The apparatus of claim 1 wherein said warp and weft bands are high tension fibers such as carbon.

* * * * *